US006332713B1

(12) United States Patent
Cohen

(10) Patent No.: US 6,332,713 B1
(45) Date of Patent: Dec. 25, 2001

(54) LIGHTWEIGHT BEAR BAG

(76) Inventor: Thomas A. Cohen, 680 Summit Ave., Mill Valley, CA (US) 94941

( * ) Notice: Subject to any disclaimer, the term of this patent is extended or adjusted under 35 U.S.C. 154(b) by 0 days.

(21) Appl. No.: 09/449,020

(22) Filed: Nov. 24, 1999

(51) Int. Cl.[7] ..... B65D 33/28
(52) U.S. Cl. ..... 383/75; 383/117
(58) Field of Search ..... 383/117, 75, 111, 383/6, 22

(56) References Cited

U.S. PATENT DOCUMENTS

| | | | | |
|---|---|---|---|---|
| Re. 35,814 | * | 6/1998 | Olson | 206/278 |
| 692,404 | * | 2/1902 | Wright | 383/117 X |
| 692,406 | * | 2/1902 | Wright | 383/117 X |
| 1,155,375 | * | 10/1915 | Shannon | 383/117 X |
| 4,203,479 | * | 5/1980 | Mathews | 383/117 X |
| 4,267,868 | * | 5/1981 | Lowe | 383/2 |
| 4,523,357 | * | 6/1985 | Widditsch | 24/600.9 |
| 5,344,109 | * | 9/1994 | Hokoana, Jr. | 248/100 |
| 5,511,846 | * | 4/1996 | Fuller | 383/117 X |
| 5,950,981 | * | 9/1999 | Judy | 248/693 |
| 6,007,245 | * | 12/1999 | Looy | 383/117 X |

OTHER PUBLICATIONS www.thesubpack.com, Date not found, Beitel, Philip 1010 Sir Francis Drake #2E Kentfield, CA 94904, 6 pages.
www.bearcan.com, Jan. 9, 1999, The Bear Can by Gio Enterprises (no address given), 2 pages.

* cited by examiner

*Primary Examiner*—Jes F. Pascua
(74) *Attorney, Agent, or Firm*—John S. Heyman

(57) ABSTRACT

A bear proof, lightweight, food sack is made from puncture and tear resistant fabric (10) sewn with high strength thread (24) and secured with an abrasion resistant cord (12). The food sack is closed by tightening the cord (12), which encircles the top of the sack in a hem (14) and emerges through a grommet (16). The cord (12) is secured by means of a cord lock (18) and an overhand knot (20). Excess cord (12) is then tied with a secure knot (22) to a fixed object, such as a tree, so that the sack cannot be removed by a bear.

5 Claims, 1 Drawing Sheet

LIGHTWEIGHT BEAR BAG

FIELD OF INVENTION

This invention relates to camping gear, specifically to a food storage bag which cannot be punctured or torn by bears or other wild animals.

DESCRIPTION OF PRIOR ART

When campers are in bear country, they often have their food stores raided and torn apart by hungry bears. For example. in 1998 in Yosemite National Park bears caused over $630,000 in property damage during their pursuit of human food and garbage. There are a number of devices on the market which attempt to solve the problem campers having storing their food in bear country.

One such device, described in U.S. Pat. No. 5,950,981 to Kenith Judy, is a suspension system designed to keep bags of the reach of bears by hanging the bags from a tree and counter-weighting them with rocks. It is likely that this system would be virtually useless against Black Bears, since they climb trees. Moreover, both Black and Grizzly bears are dextrous and smart. Thus, they would likely pull on the counterweight rope and pull the bags out of the tree. Once out of the tree a bear can easily tear open and get the food in the bag.

Another device is a submersible bag sold under the trademark Subpack by Pacific Outdoor Design. The device, which is meant to eliminate the odors which attract bears, is a waterproof food bag designed to be submersed with rocks and tied to a lake or river bank by rope. Given a bear's intelligence, it is likely that once a bear could identify the device as a source of food, it would simply retrieve it from under water and demolish it.

A widely used bear proof container is sold under the trademark Backpacker's Cache by Garcia Machine. It is made from a hard plastic material, weighs 2.7 pounds and is not compressible. Because backpackers are concerned with weight and size, the Backpacker's Cache is both heavier and more bulky than desirable.

Similarly, a container made of metal and sold under the trademark BearCan by BearCan.com has the same drawbacks as the Backpacker's Cache.

SUMMARY INCLUDING OBJECTS AND ADVANTAGES

A lightweight, impenetrable, bag made of puncture resistant and/or tear resistant fabric secured at its open end by means of a high strength cord contained in and emerging from a hem. The excess cord is then secured by means of a cord lock and a knot and is then tied around a fixed object, such as a tree trunk, with a secure knot. An optional liner, such as a vinyl dry bag or a pipe made of corrugated polyethylene, may be inserted into the bag to add crush resistance.

Objects and Advantages

The bag prevents bears and other animals from getting into a human's food supply. The advantage of this invention is its light weight and flexibility, thus enabling backpackers and others to carry it easily.

Thus, my food storage container obviates the disadvantages of prior containers thus preventing bears and other wild animals from destroying its contents; It is easily accessible to users without having to hang it from a high tree branch or submerse it under water; Also it is lightweight, enabling it to be readily carried by backpackers and others in bear country; which is compressible and flexible, thus allowing backpackers to pack it more easily and with less bulk.

Further objects and advantages will become apparent from a consideration of the ensuing description and accompanying drawings.

REFERENCE NUMERALS

Figure 1:
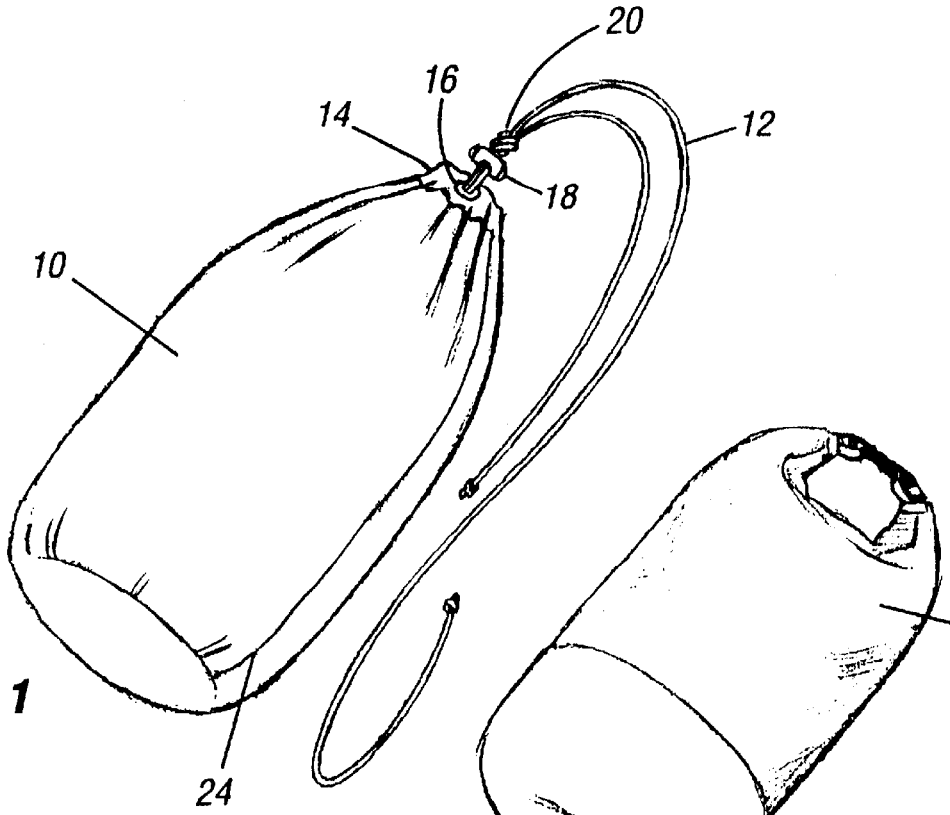
FIG. 1 is a front view of a lightweight puncture and tear resistant food sack in accordance with the invention.

10 fabric
12 cord
14 hem
16 grommet
18 cord lock
20 overhand knot
22 secure knot
24 thread
26 dry bag liner

Preferred Embodiment—Description

FIG. 1—Side View of Bear Proof Sack

FIG. 1 shows a side view of a lightweight puncture and tear resistant food sack made of fabric 10. The sack is sewn using high-strength thread 24 of UV resistant polyester and is made from fabric 10 as woven from a high-strength material, preferably that sold under the trademark Kevlar and manufactured by Warwick Mills of New Ipswich, N.H., type T9-694. The sack is closed by means of an abrasion resistant, high-strength cord 12 which is contained in a hem 14 sewn into the top of the sack. The cord emerges from the hem through a grommet 16, then runs through a conventional push-button cord lock 18, and is tied in a simple overhand knot 20. The excess cord is then tied around a fixed object, such as a tree, and is then tied into a secure knot 22. The sack is typically 8 inches in diameter and 14 inches long when cinched tight. All seams are double stitched. Cord lock 18 is made of high impact plastic. Utilizing overhand knot 20 on the outside of the cord lock enables cord lock 18 to resist pulling by teeth or claws, thus keeping the sack securely closed.

Figure 2:
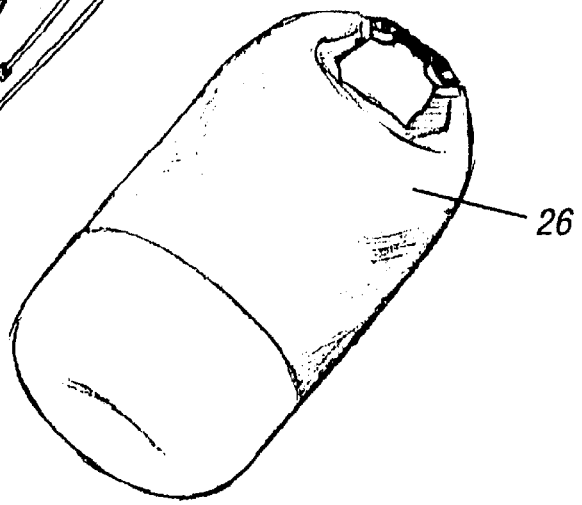
FIG. 2 is a view of the dry bag liner.

FIG. 2—View of Dry Bag Liner

FIG. 2 shows dry bag liner 26, which fits snugly inside the vertical surfaces of the sack, and, when filled with air, is designed to resist crushing forces. Dry bag liner 26 is typically made of 20 mil vinyl with closure achieved by three rolls and a side release buckle. Dry bag liner 26 is also known as a canoe bag, and is used in other contexts as a method of keeping clothes and equipment dry while boating or encountering wet weather. Here, it is used to keep air in as a method of cushioning the crushing forces of a bear. Optionally, the dry bag liner 26 may be removed, and the sack utilized without built in crush resistance.

Figure 3:
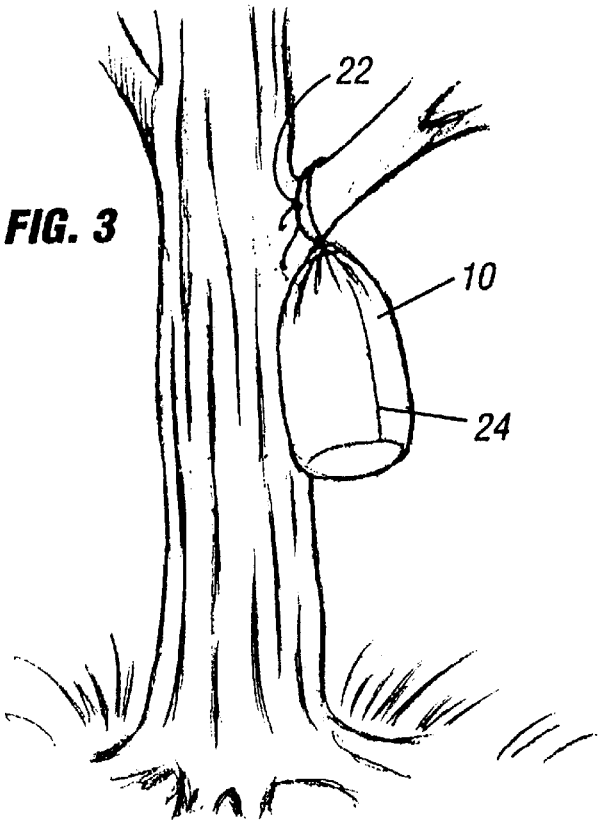
FIG. 3 is a view of the sack (FIG. 1) showing it secured to a tree.

FIG. 3—View of Sack Secured to Tree

FIG. 3 shows the sack (FIG. 1) secured to a tree. The cord 12 is wrapped at least one full turn around the tree before it is tied with secure knot 22. Tying the sack to a fixed object prevents a bear from removing the sack from a camp site. Wrapping the cord 12 at least one full turn prevents undue strain on secure knot 22, thus making it easier to untie in the event a bear pulls on the sack.

Preferred Embodiment—Operation

Operation and use of the bear bag is simple and straightforward. Once food or other odorous items (such as cosmetics) are placed in the sack, cord lock 18 is pulled tight in order to minimize the opening. Overhand knot 20 secures the cord lock 18, and then the excess cord 12 is tied securely around a fixed object, such as a tree. Cord 12 may be secured by a secure knot 22 or by a metal clasp. Once secured, the sack cannot be punctured, torn or opened because fabric 10 is impervious to the penetrating and ripping forces that can be applied by a bear. It cannot be removed since it is tied to a fixed object, and the bear cannot untie secure knot 22 or break cord 12.

Conclusions, Ramifications, and Scope

Accordingly, it can be seen that the bear bag will provide a puncture and tear-proof fabric sack that will resist attack by bears and other wildlife while at the same time providing a lightweight and flexible alternative to other bear-proof canisters on the market.

Although the description above contains many specifics, these should not be construed as limiting the scope of the invention but as merely providing illustrations of some of the presently preferred embodiments of this invention. Various other embodiments and ramifications are possible within its scope. For example, the dry bag liner need not be used at all. Alternatively, a single wall corrugated HDPE polyethylene pipe or rigid metal pipe can be used as a liner. Such pipe liners may have holes drilled in them to lighten their weight. The bag may be any size, thus making it useful for other purposes such as collecting garbage or holding an anchor on board a boat. The cord may be made of wire rope, and knot 22 can be replaced with a metal clasp or a carabiner. The sack can be made waterproof, odor proof, and UV resistant through the use of fabric coatings. The sack can be constructed of one piece of fabric instead of two. It can also have a flap sewn into the top. Grommet 16 can be replaced by leaving a small opening in hem 14, and cord lock 18 can be eliminated entirely or replaced by a different mechanical device designed to secure two cords together. Excess cord 12 and secure knot 22 may be eliminated altogether, which would still result in an impenetrable bag, but one which could be removed from its desired location. In lieu of making the bag of Kevlar fabric, it can be made of other puncture and tear resistant human made fabrics such as steel mesh cloth.

Thus the scope of the invention should be determined by the appended claims and their legal equivalents, rather than by the examples given.

What is claimed is:

1. A functionally autonomous impenetrable container for use in storing comestibles in an area where bears and other wild animals are present so that said bears and other wild animals cannot access and consume said comestibles, comprising;

a) a non-metallic, substantially non-porous, flexible, fibrous material weighing less than 14 ounces per square yard comprising a fabric which is puncture-resistant and tear-resistant to bears and other wild animals, b) means forming said material into said functionally autonomous impenetrable container in the shape of a bag compressible in both its length and breadth, said bag having an open end to enable users to place objects in said bag, said entire bag being made of said non-metallic, substantially non-porous, flexible, fibrous material weighing less than 14 ounces per square yard, and c) means for closing said bag, said means comprising a cut-resistant, high-strength tying device which is resistant to bears and other wild animals so as to prevent penetration at said open end of said bag by said bears and other wild animals, whereby said bag can be used to store food and other odorous items so that bears and other wild animals cannot access said items.

2. The container of claim 1 wherein said bag has a hem formed at said open end of said bag, said cut-resistant, high-strength tying device being contained in said hem and emerging from an opening in said hem.

3. The container of claim 1 wherein said cut-resistant, high-strength tying device includes free ends of sufficient length for tying around a tree or another fixed object of a predetermined dimension.

4. The container of claim 1 wherein said material comprises a bottom section and a side section and said means for forming said material into a bag comprises a bottom seam attaching said bottom section to said side section.

5. The container of claim 1 wherein said bag is made of aramid fiber.

* * * * *